US007424899B2

(12) United States Patent
Mouri et al.

(10) Patent No.: US 7,424,899 B2
(45) Date of Patent: Sep. 16, 2008

(54) HOLLOW-WEAVE AIRBAG

(75) Inventors: Kazuhiko Mouri, Kariya (JP); Syuuichi Katou, Kariya (JP); Hiroyasu Saiki, Kariya (JP); Eishichi Nakamura, Nishikasugai-gun (JP); Shinya Tokunaga, Toyota (JP)

(73) Assignees: Toyoda Boshoku Corporation, Kariya (JP); Toyoda Gosei Co., Ltd., Nishikasugai (JP); Toyota Jidosha Kabushiki Kaisha, Toyota (JP)

( * ) Notice: Subject to any disclaimer, the term of this patent is extended or adjusted under 35 U.S.C. 154(b) by 516 days.

(21) Appl. No.: 10/507,523

(22) PCT Filed: Mar. 14, 2003

(86) PCT No.: PCT/IB03/00923

§ 371 (c)(1),
(2), (4) Date: Feb. 22, 2005

(87) PCT Pub. No.: WO03/078711

PCT Pub. Date: Sep. 25, 2003

(65) Prior Publication Data

US 2005/0130520 A1 Jun. 16, 2005

(30) Foreign Application Priority Data

Mar. 15, 2002 (JP) ..... 2002-073327

(51) Int. Cl.
*D03D 3/00* (2006.01)

(52) U.S. Cl. ..... 139/384 R; 280/728.1; 280/730; 280/743.1; 139/383 R; 428/35.2; 442/76; 442/181

(58) Field of Classification Search ..... 112/10; 280/728.1, 730, 743.1; 139/383 R, 384 R, 139/386, 387 R; 383/3, 117, 118, 907; 428/35.2; 442/76, 181

See application file for complete search history.

(56) References Cited

U.S. PATENT DOCUMENTS

| | | | |
|---|---|---|---|
| 5,098,125 | A | 3/1992 | Thornton et al. |
| 5,441,798 | A | 8/1995 | Nishimura et al. |
| 5,865,464 | A | 2/1999 | Kanuma et al. |
| 2002/0130503 | A1 | 9/2002 | Matsui et al. |

FOREIGN PATENT DOCUMENTS

| | | |
|---|---|---|
| JP | U 50-145875 | 5/1949 |
| JP | A 2-204151 | 8/1990 |
| JP | A 03-016850 | 1/1991 |
| JP | A 03-016852 | 1/1991 |
| JP | A 03-016853 | 1/1991 |
| JP | A 2000-229550 | 8/2000 |

(Continued)

*Primary Examiner*—Arti Singh
(74) *Attorney, Agent, or Firm*—Oliff & Berridge, PLC

(57) ABSTRACT

A hollow-weave airbag is constituted of a bag portion (11) with a 1/1 bag structure, and a closed portion (12) that has two or more weave structures and adjoins the bag portion 11. In addition, the closed portion (12) is constituted of, in sequence from the bag portion side, a first weave structure 12A with a 2/2 structure, a second weave structure 12B with a 1/1 structure, and a third weave structure with a 3/3 structure. Furthermore, the 2/2 structure is constituted of 3 to 5 weft yarns, and the 1/1 structure is constituted of 2 to 5 weft yarns.

18 Claims, 6 Drawing Sheets

FOREIGN PATENT DOCUMENTS

| | | |
|---|---|---|
| JP | A 2001-071847 | 3/2001 |
| JP | A 2001-233153 | 8/2001 |
| JP | A 2001-513154 | 8/2001 |
| JP | A 2003-510469 | 3/2003 |
| KR | 0184711 | 5/1999 |
| WO | WO 99/32332 A1 | 7/1999 |
| WO | WO 01/21870 A1 | 3/2001 |

HOLLOW-WEAVE AIRBAG

FIELD OF THE INVENTION

This invention relates to a hollow-weave airbag. More specifically, it relates to a hollow-weave airbag that suppresses opening of stitches at a boundary of a bag portion and a closed portion even on deployment and, as well as being able to secure sufficient airtightness, is able to maintain a deployed state for a certain period of time or more.

BACKGROUND OF THE INVENTION

Hollow-weave airbags are used for purposes such as absorbing impacts by being caused to deploy through air being fed instantly into a bag portion structure and maintaining that deployed state for a predetermined period of time.

In recent years, these hollow-weave airbags have been used in various applications. For example, hollow weave airbags are used in life jackets, life boats, mats, home elevators, and have been installed in vehicles where, by deploying when a vehicular collision occurs, they are used as airbags that protect the head and chest portions of vehicle occupants.

In addition, one of the most important requirements for this kind of hollow-weave airbag is that a bag portion of the airbag should have excellent airtightness, such that it is able to deploy and maintain an inflated state. Furthermore, in recent years, many of the airbags that are installed in vehicles have been provided at vehicle pillars and seat sides, in order to protect the side of the head of a vehicle operator in the event of a roll-over or an impact from the side. It is necessary that this type of airbag secures the deployed state for a certain period of time in order to protect the head of a vehicle occupant, not only at the point of impact but also during the roll-over or the like afterwards. In recent years, therefore, it has been highly important for hollow-weave airbags to possess not only excellent airtightness, but also be able to secure the deployed state for the certain period of time, and be compactly storable to enable provision in the pillars or seat sides of the vehicle.

Depending on the structure, however, some hollow-weave airbags are likely to cause stitches at a boundary of the bag portion and a closed portion to open on deployment of the airbag due to air pressure inside the airbag. If this opening of stitches occurs on deployment, airtightness decreases, causing strength insufficiencies at the boundary portion or gas leaks. As a result, it may become difficult to maintain the airbag in the deployed state for a certain period of time or more.

Various airbags have been developed in order to solve this problem. For example, in Japanese Patent Laid-Open Publication No. 2000-229550, a hollow-weave airbag is disclosed that is formed with a triple weave portion and a quadruple weave portion, which have a yarn density ratio lower than a circumferential edge portion, in a peripheral area that includes a boundary of the bag portion and the closed portion, and where a coating layer is formed not only on a front face side, but also on a back face side by using a coating agent that permeates to the back side. Furthermore, in Japanese Patent Laid-Open Publication No. 2001-233153, a hollow-weave airbag is disclosed that has a 3/n basket weave structure (n is an integer of 2 or more) of only one warp yarn at the boundary of the bag portion and the closed portion on a single-layered structure. The single-layered structure other than the boundary of the bag portion and the closed portion has a 3/n basket weave structure (n is an integer of 2 or more) that has n warp yarns in a continuous fashion with the boundary portion, and a cover factor on the single-layered structure of 4,000 or more.

Although the hollow-weave airbags disclosed in both Japanese Patent Laid-Open Publication No. 2000-229550 and Japanese Patent Laid-Open Publication No. 2001-233153 possess airtightness superior to conventional hollow-weave airbags, however, it is necessary to carry out a separate coating process in order to form a coating layer in the former hollow-weave airbag, which makes the manufacturing process complicated and is also likely to increase costs. Furthermore, if the coating layer becomes too thick, folding up the airbag compactly may become difficult. On the other hand, although the latter hollow-weave airbag has superior airtightness, densifying the weave structure at the boundary in order to prevent opening of stitches at the boundary of the bag portion and the closed portion expands the boundary and makes the coating layer susceptible to non-uniformity, and as a result, compact folding may become difficult. Furthermore, although it is preferable that the weave structure of the boundary of the hollow-weave airbag be of a curved-line structure rather than a straight-line structure, in order to increase freedom of design as well as so that gas pressure is suitably dispersed rather than stress being concentrated, no mention is made in the above laid-open publications of how to maintain airtightness in the event that the weave structure at the boundaries is given the curved-line structure.

SUMMARY OF THE INVENTION

The invention is contrived in view of the foregoing problems, and it is an object of the invention to provide a hollow-weave airbag that suppresses opening of stitches at a boundary of a bag portion and a closed portion even on deployment and, as well as being able to secure sufficient airtightness, is able to maintain a deployed state for a certain period of time or more.

A hollow-weave airbag according to a first aspect of the invention is constituted of a bag portion and a closed portion that has two or more weave structures and adjoins the bag portion. The closed portion is constituted of, in sequence from the bag portion side, a first weave structure and a second weave structure, which adjoins a side of the first weave structure opposite the bag portion side, and the first weave structure includes one or more portions with a looser weave structure than the second weave structure. In addition, the first weave structure may adjoin the bag portion. Furthermore, the first weave structure may have a 2/2 structure. In this case, the 2/2 structure may be constituted of 3 to 5 warp yarns, or 3 to 5 weft yarns. Moreover, the second weave structure may have a 1/1 structure. In this case, the 1/1 structure may be constituted of 2 to 5 warp yarns or 2 to 5 weft yarns. In addition, the interlace densities of the first weave structure and the second weave structure of the bag portion may satisfy one or more of the conditions as shown in (1) to (3) below. (However, this excludes a case where the interlace density of the first weave structure and the interlace density of the second weave structure are both 4/3).

(1) The interlace density of the bag portion is 1/2 or less.

(2) The interlace density of the first weave structure is from 2/3 or more to 4/3 or less.

(3) The interlace density of the second weave structure is 4/3 or more. Furthermore, the hollow-weave airbag according to the first aspect of the invention may possess a third weave structure that adjoins a side opposite the bag portion side of the second weave structure. In this case, the third weave structure may have a looser weave structure than the second weave structure. Moreover, the value for the interlace density of the first weave structure may be a value between the value for the interlace density of the second weave structure and the value for an interlace density of the third weave structure. In addition, the third weave structure may have an n/m structure (where n and m are both integers of 1 or more, excluding, however, a 1/1 structure). Moreover, the interlace density of the third weave structure may be 1 or less.

Furthermore, a hollow-weave airbag according to a second aspect of the invention is constituted of a bag portion and a closed portion that adjoins the bag portion and has two or more weave structures. Of weave structures that constitute the closed portion, a weave structure that adjoins the upper bag portion is a reversed bag structure where a lower cloth thereof is formed of warp yarns and weft yarns that constitute an upper cloth of the bag portion, and an upper cloth thereof is formed of warp yarns and weft yarns that constitute a lower cloth of the bag portion. Moreover, the reversed bag structure may be formed of warp yarns and 3 to 7 and weft yarns that constitute the weave structure of the bag portion.

Furthermore, at least one portion of an outer surface of the bag portion and/or the closed portion of both the hollow-weave airbags according to the first and second aspects may be coated. Moreover, the weave structure that constitutes the boundary of the bag portion and the closed portion of both the hollow-weave airbags according to the first and second aspects may have a curved line structure.

The hollow-weave airbag according to the first aspect lessens sudden variations in yarn density at the boundary of the bag portion and the closed portion, and because the weave structure that adjoins the closed portion has a similar roughness, stress is not concentrated on deployment and opening of stitches can be suppressed. Furthermore, in the hollow-weave airbag according to the second aspect, the boundary of the bag portion and the closed portion becomes a buffer portion for air pressure and can suppress the opening of stitches because the weave structure of the closed portion that adjoins the bag portion has the reversed bag structure. Therefore, the hollow-weave airbags according to the first and second aspects secure sufficient airtightness at the boundary of the bag portion and the closed portion even on deployment, and can maintain the deployed state for the certain time or more. In addition, the hollow-weave airbags according to the first and second aspects can suppress the opening of stitches even when the boundary of the bag portion and the closed portion has a curved line structure and secure excellent airtightness. Furthermore, the design of the hollow-weave airbag has a high degree of freedom and high versatility.

DETAILED DESCRIPTION OF THE PREFERRED EMBODIMENTS

Hereafter, embodiments of the invention are described in detail with reference to the drawings.

Figure 1:
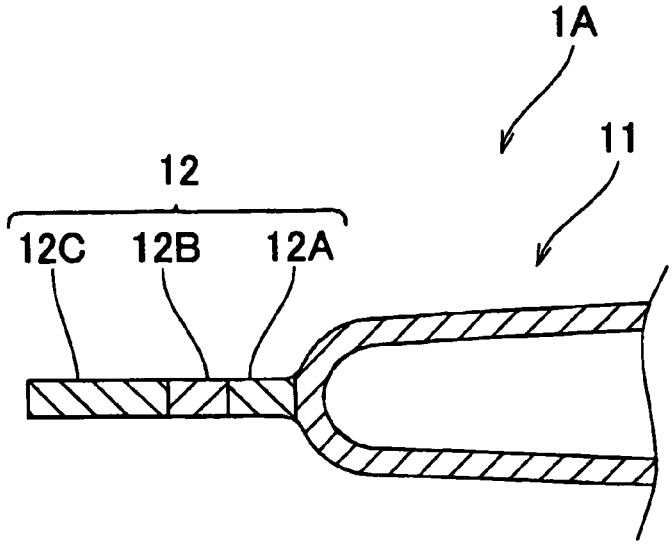
FIG. 1 is a partially enlarged cross-sectional view of a hollow-weave airbag according to a first embodiment of the invention.
Figure 3:
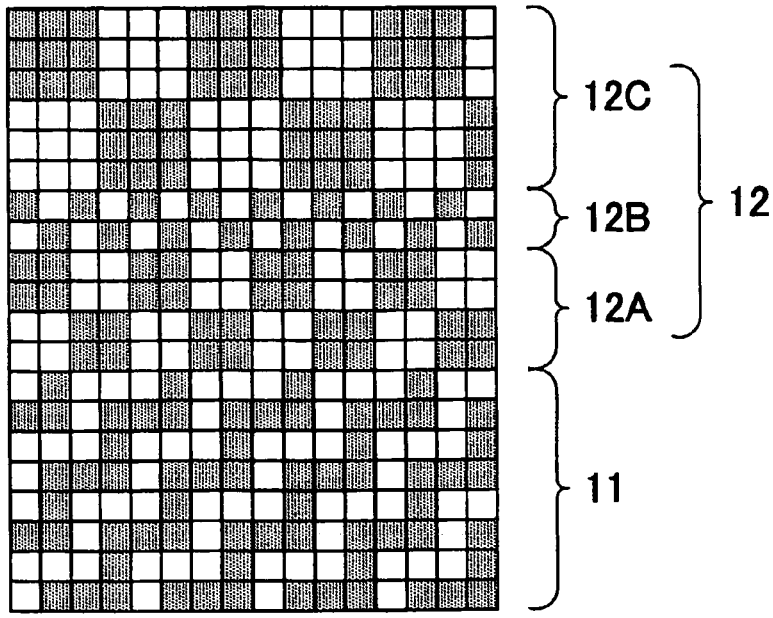
FIG. 3 is an explanatory drawing of a minimum component unit of a weave structure of the hollow-weave airbag according to the first embodiment of the invention.

FIG. 1 shows a partially enlarged cross-sectional view of a hollow-weave airbag according to a first embodiment of the invention. Furthermore, FIG. 3 shows an explanatory drawing of a minimum component unit of a weave structure. The overall form of the hollow-weave airbag 1A according to the invention has no specific limitations, but normally, it is formed with a substantially rectangular shape. In addition, the hollow-weave airbag 1A according to this embodiment has a bag portion 11 that deploys by means of an inflow of gas from an opening portion (not shown on drawing) that is provided in an arbitrary location on the hollow-weave airbag 1A, and a closed portion 12 that adjoins the bag portion 11 and is closed such that a gas leak will not occur. Furthermore, the closed portion 12 is constituted of a first weave structure 12A, a second weave structure 12B and a third weave structure 12C, adjoining each other in sequence from the bag portion side. The closed portion 12 is formed of a single-layered weave, but the invention is not specifically limited to this. Moreover, the hollow-weave airbag according to this embodiment is provided with a curved-line shape closed portion even on a central portion, by means of which the hollow-weave airbag according to this embodiment is divided into a plurality of expansion chambers, but the invention is not specifically limited to this.

The closed portion of the hollow-weave airbag according to this embodiment possesses two or more structures and is constituted of, in sequence from the bag portion side, the first weave structure and the second weave structure, which adjoins a side of the first weave structure opposite the bag portion side (the opposite side to the bag portion side). Furthermore, the first weave structure includes one or more portions with a looser weave structure than the second weave structure. FIGS. 1 and 3 are diagrams where the first weave structure 12A is looser than the second weave structure 12B. Here, the description, "the first weave structure is looser than the second weave structure," indicates a case where at least one of the conditions (1) and (2) below are satisfied.

(1) When the first weave structure has an "n1 (m1 weave structure" and the second weave structure has an "n2 (m2 weave structure," n1, m1, n2 and m2 are all integers of 1 or more and (n1+m1)>(n2+m2)

(2) (The interlace density of the first weave structure)<(The interlace density of the second weave structure).

The aforementioned interlace density is a value calculated according to the formula below. In general, when the weave structure is an $\alpha-\beta$ basket weave structure, the interlace density has the relationship, $(\alpha+\beta)/\alpha\beta$.

Figure 10A:
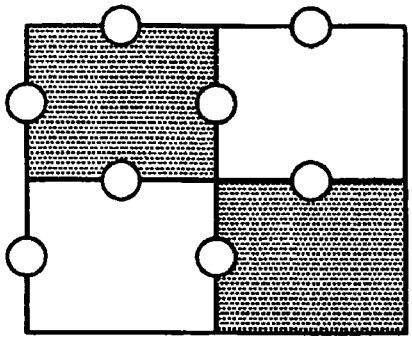
FIG. 10A is an explanatory drawing of the interlace density of a 1/1 plain weave.
Figure 10B:
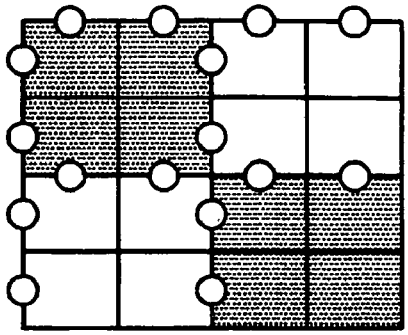
FIG. 10B is an explanatory drawing of the interlace density of a 2/2 basket weave structure.
Figure 10C:
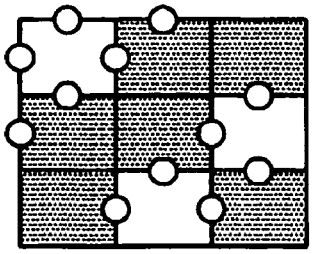
FIG. 10C is an explanatory drawing of the interlace density of a 2/1 twill weave.

Interlace density=*a/b* a: Number of interlacing points on a complete structure chart (minimum component unit that shows weave structure). (Number of points where warp yarns and weft yarns intersect. On FIGS. 10A to 10D, a white circle indicates an interlacing point. The number of interlacing points is the number of these white circles. The number of interlacing points on FIG. 10A is 8, FIG. 10B is 16, FIG. 10C is 12, and FIG. D is 8.)

b: Number of meshes on the complete structure chart (number of grids. FIG. 10A has 4, FIG. 10B has 16, FIG. 10C has 9, and FIG. 10D has 16).

The form of the first weave structure and the second weave structure are not specifically limited provided that the above conditions are satisfied. For example, an appropriate publicly known weave, such as a plain weave, a twill weave, a basket weave or a diagonal weave, may be selected as the first weave structure and the second weave structure. Furthermore, a structure such as an n/n' structure (where n and n' are integers of 1 or more, and n may be equal to n'), such as a 1/1 structure, a 2/1 structure, a 1/2 structure, a 2/2 structure, a 2/3 structure, a 3/3 structure, a 3/2 structure, or the like may be selected and combined as the weave structure for the first weave structure and the second weave structure. Furthermore, it is preferable that the interlace density of the first weave structure be from 2/3 or more to 4/3 or less, but it is more preferable that it be larger than 2/3 and less than 4/3, and it is even more preferable that it be from 5/6 or more to 1 or less. Moreover, it is preferable that the interlace density of the second weave structure be 4/3 or more, but it is more preferable that it be larger than 4/3, and it is even more preferable that it be 3/2 or more. However, the interlace densities for the first weave structure and the second weave structure may not both be 4/3.

More specifically, a 3/3 basket weave structure (interlace density=2/3), a 3/2 basket weave structure (interlace density=5/6), a 2/2 basket weave structure (interlace density=1, see FIG. 10B), a 2/2 twill weave structure (interlace density=1), a 2/1 twill weave structure (interlace density=4/3, see FIG. 10C), or the like can be proposed as the first weave structure. Furthermore, a 2/1 twill weave structure (interlace density=4/3), a 1/2 basket weave structure (interlace density=3/2), a 1/1 plain weave structure (interlace density=2), or the like can be proposed as the second weave structure. Even more specifically, for example, the first weave structure 12A may be given a 2/2 weave structure (preferably a 2/2 basket weave structure) and the second weave structure 12B may be given a 1/1 plain weave structure, as shown in FIG. 3. Employing this kind of configuration is preferable since it enables airtightness to be further improved.

Furthermore, there are no specific limitations regarding the number of weft yarns and warp yarns that constitute the first weave structure and the second weave structure, and various numbers are possible depending on requirements. In the example of the weave structure in the aforementioned closed portion given above, i.e. when utilizing the 2/2 structure (preferably a 2/2 basket weave structure) as the first weave structure, it is preferable that the number of weft yarns and warp yarns that constitute the 2/2 structure be from 3 to 5, but it is more preferable that it be from 3 to 4, or 4 to 5. Furthermore, also in the example of the weave structure in the closed portion given above, i.e. when utilizing the 1/1 plain weave structure as the second weave structure, it is preferable that the number of weft yarns and warp yarns that constitute the 1/1 plain weave structure be from 2 to 5, but it is more preferable that it be from 3 to 5, and it is even more preferable that it be from 4 to 5. Each of these configurations is preferable since they enable a hollow-weave airbag to be produced that has an even more excellent airtightness. Moreover, when the first weave structure has the 2/2 structure (preferably the 2/2 basket weave structure) and the second weave structure has the 1/1 plain weave structure, it is preferable to set the number of weft yarns and warp yarns that constitute the 2/2 structure and the 1/1 structure within the ranges detailed above, since this will enable airtightness to be further improved.

In addition, in the above description of the hollow-weave airbag according to the invention, "constituted of, in sequence from the bag portion side, the first weave structure and the second weave structure, which adjoins a side of the first weave structure opposite the bag portion side, and the first weave structure includes a portion with a looser weave structure than the second weave structure," if this portion is included in the closed portion, then it may be included anywhere in the closed portion. Normally, the first weave structure adjoins the bag portion. In other words, as shown in FIGS. 1 and 3, the first weave portion 12A adjoins the opposite bag portion side of the bag portion 11 and, therefore, the portion indicated in the aforementioned description, "constituted of, in sequence from the bag portion side, of the first weave structure and the second weave structure, which adjoins a side of the first weave structure opposite the bag portion, and the first weave structure includes a portion with a looser weave structure than the second weave structure," (the first weave structure 12A and the second weave structure 12B in FIGS. 1 and 3) in turn exist adjoining the bag portion 11.

Furthermore, no specific limitation is made regarding the number of portions in the closed portion indicated in the aforementioned description, "constituted of, in sequence from the bag portion side, of the first weave structure and the second weave structure, which adjoins a side of the first weave structure opposite the bag portion, and the first weave structure includes a portion with a looser weave structure than the second weave structure," provided that there is at least one. The number of the aforementioned portions in the hollow-weave airbag according to the invention is usually 1 to 4, but it is more preferable that the number be 1 to 3, and it is even more preferable that the number be 1, as shown in FIGS. 1 and 3.

As shown in FIG. 1, the hollow-weave airbag according to the invention may have, as a structure that constitutes the closed portion 12, the third weave structure adjoining a side of the second weave structure 12B opposite the bag portion side. By having the third weave structure, the variation in the interlace densities in the bag portion and the closed portion are further lessened, which disperses stress caused by air pressure on deployment, and is preferable since it enables an excellent airtightness to be achieved. There are no specific limitations regarding the form of the third weave structure, and it may be given various weave structures as necessary. For example, an appropriate publicly known weave, such as a plain weave, a twill weave, a basket weave or a diagonal weave, may be selected for the third weave structure. The third weave structure is normally formed of a single-layered weave structure, but it is not specifically limited to this. Moreover, the third weave structure may be given an n/m structure (where n and m are integers of 1 or more, and n may be equal to m. However, the 1/1 structure is excluded) such as the 2/1 structure, the 1/2 structure, the 2/2 structure, the 2/3 structure, the 3/3 structure, the 3/2 structure, or the like. It is more preferable to be able to use a n'/m' basket weave structure (where n' and m' are integers of 3 or more, and n' may be equal to m') such as the 3/3 basket weave structure, a 3/4 basket weave structure, a 4/4 basket weave structure, a 5/5 basket weave structure, or the like.

More specifically, of these options, it is preferable that the third weave structure be looser than the second weave structure. Here, "looser weave structure" has the same meaning as the definition detailed above. (However, in the above definition, "the first weave structure" should be replaced by "the third weave structure.") Furthermore, there are no specific limitations regarding the interlace density of the weave structure 3, but from the point of view of airtightness, it is preferable that the interlace density of the first weave structure be a value between the interlace density of the second weave structure and the interlace density of the third weave structure. More specifically, the interlace density of the third weave structure should be one or less, preferably less than 1, more preferably 5/6 or less and even more preferably 2/3 or less. For example, the 2/2 basket weave structure (interlace density=1), the 3/2 basket weave structure (interlace density=5/6), the 3/3 basket weave structure (interlace density=2/3), the 4/4 basket weave structure (interlace density=1/2), a 5/5 basket weave structure (interlace density=2/5), or the like can be proposed as weave structures that fall into these ranges.

The configuration of the closed portion of the hollow-weave airbag according to this invention is not specifically limited provided that these conditions are satisfied, and various configurations are possible as required. It is preferable that the configuration of the closed portion be as follows. The interlace density of the first weave structure should be from 2/3 or more to 4/3 or less, but it is preferable that it be larger than 2/3 and less than 4/3, and it is more preferable that it be from 5/6 or more to 1 or less. The interlace density of the second weave structure should be 4/3 or more, but it is more preferable that it be larger than 4/3, and it is even more preferable that it be 3/2 or more. (However, the interlace densities for the first weave structure and the second weave structure may not both be 4/3). The interlace density of the third weave structure should be 1 or less, but it is more preferable that it be less than 1, and it is even more preferable that it be 5/6 or less. More specifically, an interlace density that falls within the aforementioned ranges may be a suitable combination configuration of the weave structures shown above. A preferable configuration is, as shown in FIG. 3, a configuration where the first weave structure 12A has the 2/2 structure (the 2/2 basket weave structure, the 2/2 twill weave structure, or the like), the second weave structure 12B has the 1/1 structure (1/1 plain weave structure or the like), and the third weave structure 12C has a n/m structure (where n and m are integers of 3 or more, and n may be equal to m).

Figure 10D:
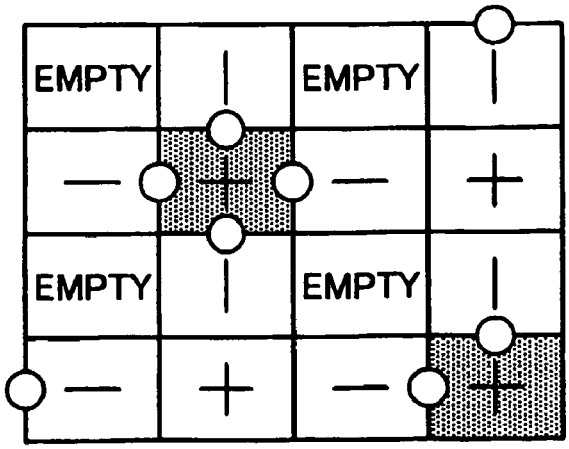
FIG. 10D is an explanatory drawing of the interlace density in a bag portion plain weave.

There are no specific limitations regarding the form of the bag portion 11 of the hollow-weave airbag according to this invention, and various forms are possible as required. Normally, the bag portion is formed from a double-layered weave. Furthermore, an appropriate publicly known weave, such as a plain weave, a twill weave, a basket weave or a diagonal weave, may be selected as the weave of the bag portion 11. Moreover, there are also no specific limitations regarding the weave structure of the bag portion. For example, an n/n' bag structure (where n and n' are integers of 1 or more, and n may be equal to n'), such as a 1/1 bag structure, a 2/1 bag structure, a 1/2 bag structure, a 2/2 bag structure, a 2/3 bag structure, a 3/3 bag structure, a 3/2 bag structure, or the like may be proposed as the weave structure for the bag portion. Furthermore, the interlace density for the bag portion is normally 1/2 or less, but it is preferable that it be 2/5 or less. Here, it is preferable that the weave structure of the bag portion have a smaller interlace density than, of the structures that constitute the closed portion, the structure that adjoins the opposite bag portion side of the bag portion. A more specific example of the weave structure of the bag portion is proposed in the bag portion plain weave (interlace density 1/2) as shown in FIG. 10D. (the "empty" spaces shown in FIG. 10D are portions with no yarn, "–" indicates a weft yarn, "|" indicates a warp yarn, and "+" indicates an apex where a warp yarn and a weft yarn cross.)

As a specific example for a configuration of the bag portion and the closed portion of the hollow-weave airbag according to the invention, an item can be proposed where the interlace densities of the bag portion, the first weave structure and the second weave structure should satisfy at least one of the conditions (1) to (3) detailed below, but it is preferable that at least two be satisfied, and it is more preferable that all three of them be satisfied. (However, this excludes a case where the interlace density of the first weave structure and the interlace density of the second weave structure are both 4/3). Furthermore, when the closed portion possesses the third weave structure, as a specific example for a configuration of the bag portion and the closed portion of the hollow-weave airbag according to the invention, an item can be proposed where at least one of the conditions (1) to (4) detailed below is satisfied, but it is preferable that at least two be satisfied, and it is more preferable that at least three be satisfied, and it is even more preferable that all four of them be satisfied. (However, this excludes a case where the interlace density of the first weave structure and the interlace density of the second weave structure are both 4/3).

(1) The interlace density of the bag portion is 1/2 or less.
(2) The interlace density of the first weave structure is from 2/3 or more to 4/3 or less.
(3) The interlace density of the second weave structure is 4/3 or more.
(4) The interlace density of the third weave structure is 1 or less.

Normally in conventional hollow-weave airbags, the interlace densities of the bag portion and the closed portion are different and there are large variations in the interlace density at a boundary portion of the bag portion and the closed portion. Therefore, on deployment, stress concentrates at the boundary portion of the bag portion and the closed portion where the interlace density varies, causing a susceptibility to gas leaks due to opening of stitches. Furthermore, the opening of stitches above a predetermined level may cause fracturing to a coating layer. On the other hand, the hollow-weave airbag according to the invention employs the configuration as detailed above and, by alleviating the variations in interlace density at the bag portion and the closed portion, disperses the stress caused by air pressure on deployment. As a result of suppressing the opening of stitches, excellent airtightness is achieved on deployment and the deployed state can be maintained for a predetermined period of time.

Figure 2:
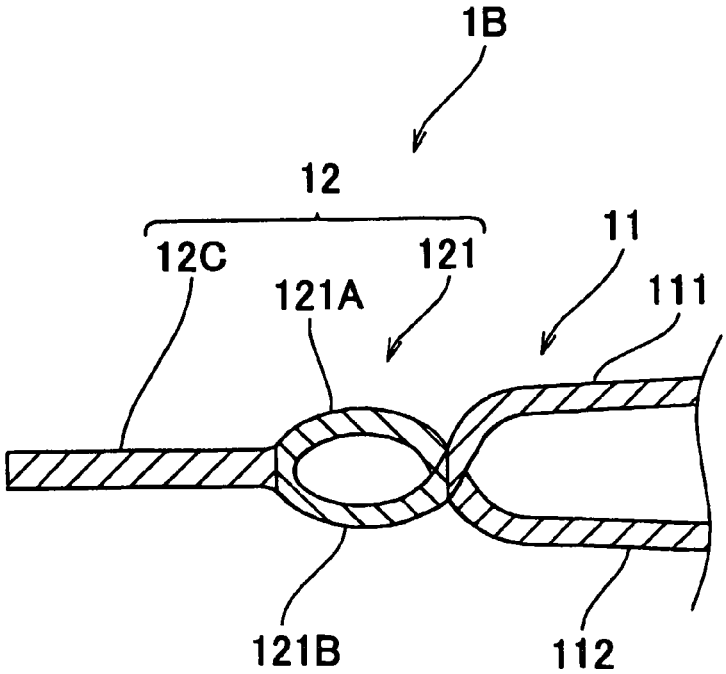
FIG. 2 is a partially enlarged cross-sectional view of a hollow-weave airbag according to a second embodiment of the invention.
Figure 5:
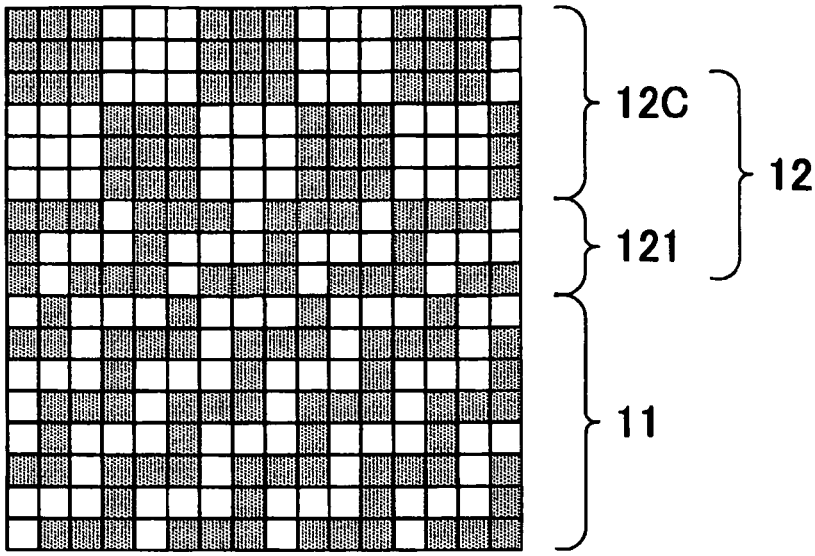
FIG. 5 is an explanatory drawing of a minimum component unit of a weave structure of a hollow-weave airbag according to a third embodiment of the invention.

FIG. 2 shows a partially enlarged cross-sectional view of a hollow-weave airbag according to a second embodiment of the invention. Furthermore, FIG. 5 shows an explanatory drawing of a minimum component unit of a weave structure. In the same way as for the first embodiment of the hollow-weave airbag, the overall form of the hollow-weave airbag 1B according to the second embodiment of the invention has no specific limitations, but normally, it is formed with a substantially rectangular shape. Thus, the hollow-weave airbag 1B according to the second embodiment has a bag portion 11 that deploys by means of an inflow of gas from an opening portion (not shown on drawing) that is provided in any location on the hollow-weave airbag 1B, and a closed portion 12 that adjoins the bag portion 11 and is closed such that a gas leak will not occur. The closed portion 12 is constituted of a reversed bag structure 121 that adjoins the opposite bag portion side of the bag portion 11, and a third weave structure 12C that adjoins a side of the reversed bag structure 121 opposite the bag portion side.

Of the weave structures that constitute the closed portion 12 of the hollow-weave airbag 1B according to the second embodiment, the weave structure that adjoins the bag portion 11 is, as shown in FIG. 2, the reversed bag structure 121. In other words, a lower cloth 121B of the reversed bag structure 121 is formed of warp yarns and weft yarns that constitute an upper cloth 111 of the bag portion 11, and an upper cloth 121A of the reversed bag structure 121 is formed of warp yarns and weft yarns that constitute a lower cloth 112 of the bag portion 11. Employing this configuration lessens stress caused by gas pressure and suppresses opening of stitches of a boundary portion and can prevent gas leaks, as a result of the boundary portion being used as a buffer to the gas pressure.

Provided that the reversed bag structure 121 is formed such that the lower cloth 121B of the reversed bag structure 121 is formed of warp yarns and weft yarns that constitute the upper cloth 111 of the bag portion 11, and the upper cloth 121A of the reversed bag structure 121 is formed of warp yarns and weft yarns that constitute the lower cloth 112 of the bag portion 11, there are no specific limitations on the weave structure thereof. It is preferable, however, that in a hollow-weave airbag according to the second embodiment, the reversed bag structure 121 be formed of the 3 to 7 weft yarns that constitute the weave structure of the bag portion 11, and it is more preferable that it be formed of 3 to 6 weft yarns, and it is even more preferable that it be formed of 3 to 5 weft yarns. This configuration is preferable because it further suppresses opening of stitches at the boundary of the bag portion and the closed portion and can secure an even more excellent airtightness.

Furthermore, as shown in FIG. 2, in the hollow-weave airbag according to the second embodiment of the invention, the third weave structure 12C may be provided on the side of the reversed bag structure 121 opposite the bag portion side. At least one third of the weave structure 12C may adjoin the side of the reversed bag structure 121 opposite the bag portion side, but there are no specific limitations regarding the number thereof and it may be constituted of one type of structure, or of a structure with two or more different weave structures.

There are no specific limitations regarding the form of the bag portion 11 and the third weave structure 12C of the hollow-weave airbag according to the second embodiment. Normally, the bag portion 11 is formed from a double-layered weave and the third weave structure is formed from a single-layered weave. Furthermore, an appropriate publicly known weave, such as a plain weave, a twill weave, a diagonal weave, or the like may be selected as the weave of the bag portion 11 and the third weave structure 12C. Moreover, there are also no specific limitations regarding the weave structures of the bag portion 11 and the third weave structure 12C, and for example, an n/n' structure (where n and n' are integers of 1 or more, and n may be equal to n'), such as a 1/1 structure, a 2/1 structure, a 1/3 structure, a 2/2 structure, a 3/3 structure, or the like may be used. It is preferable that, as shown in FIG. 5, the weave structure of the bag portion 11 be the 1/1 bag structure. Furthermore, of the structures that constitute the closed portion 12, the third weave structure 12C should be an n/n' structure (where n and n' are integers of 1 or more, and n may be equal to n', excluding n and n'=1) with a lower interlace density than the 1/1 structure, such as the 2/2 or the 3/3 structure.

In the hollow-weave airbags according to the first and second embodiments, at least one portion of an outer surface of the bag portion and/or the closed portion may be coated with silicone resin or the like. Doing this enables a further increase in airtightness. In this case, there are no specific limitations regarding the coating locations if at least one portion of the outer surface of the bag portion and/or the closed portion is coated, but it is preferable that a location be the outer surface of the bag portion and/or the closed portion that includes at least the boundary of the bag portion and the closed portion.

The weave structure that constitutes the boundary of the bag portion and the closed portion of the hollow-weave airbags according to the first and second embodiments may have a straight-line structure, but a curved-line weave structure is also possible. Using the curved-line structure is preferable because it increases freedom of design of the hollow-weave airbag, enables the gas pressure to be suitably dispersed and possesses the same excellent air tightness as the straight-line structure.

EXAMPLES

Hereafter, the embodiments of the invention will be explained in more detail by citing practical examples.

(1) Configuration of Hollow-Weave Airbag

Figure 4:
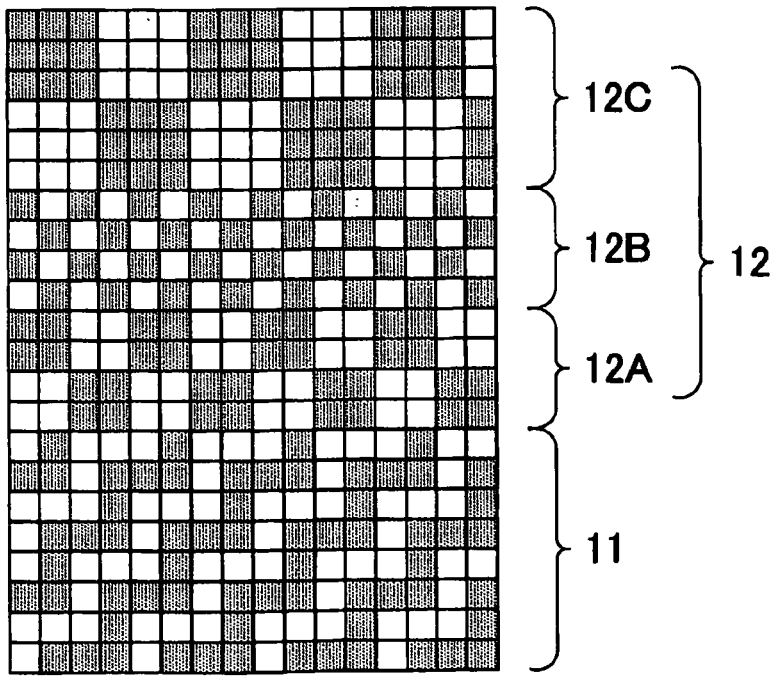
FIG. 4 is an explanatory drawing of a minimum component unit of a weave structure of the hollow-weave airbag according to the second embodiment of the invention.
Figure 6:
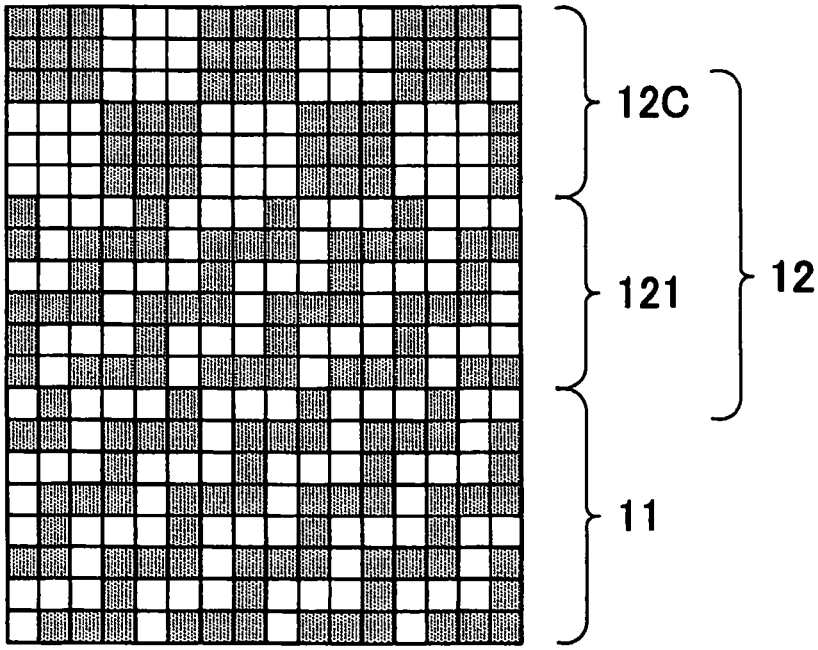
FIG. 6 is an explanatory drawing of a minimum component unit of a weave structure of a hollow-weave airbag according to a fourth embodiment of the invention.
Figure 7:
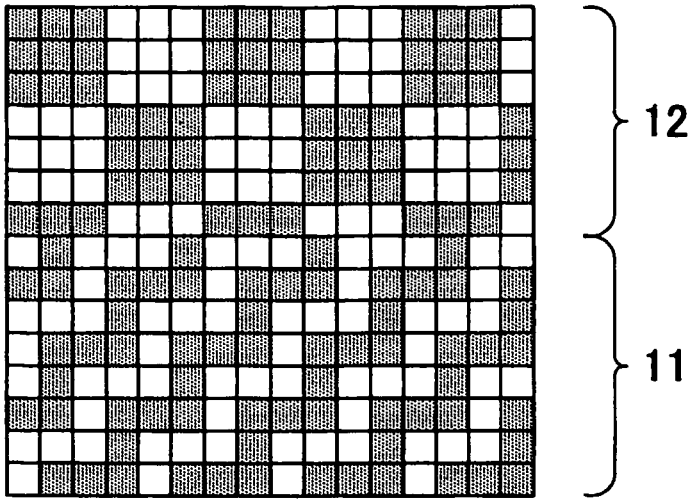
FIG. 7 is an explanatory drawing of a minimum component unit of a weave structure of a hollow-weave airbag according to comparison example 1.
Figure 8:
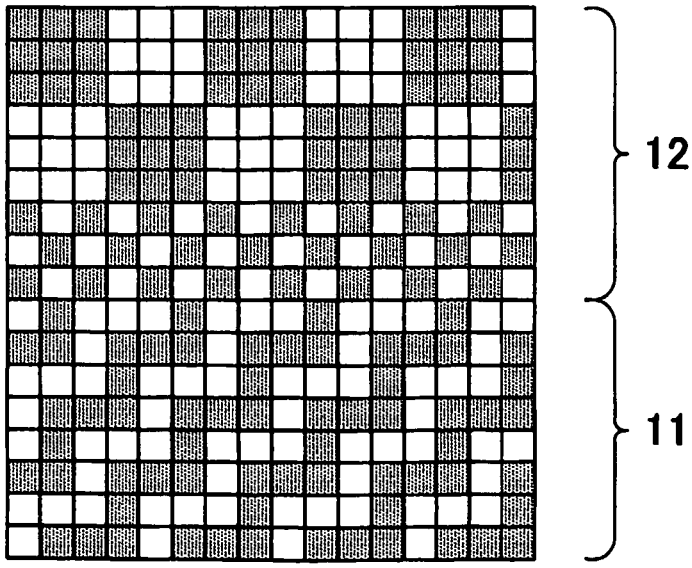
FIG. 8 is an explanatory drawing of a minimum component unit of a weave structure of a hollow-weave airbag according to comparison example 2.

The hollow-weave airbags according to the practical examples and comparison examples are woven using 350 dtex 108 nylon material yarn for the warp yarns and weft yarns, and carried out with the number of implanted yarns at 135/inch longitudinally and 122/inch laterally (1/2 of that figure in one bag portion), such that the boundary of the bag portion 11 and the closed portion 12 form a curved-line structure. Furthermore, coating is carried out in the hollow-weave airbags according to the practical examples and comparison examples, so that the coating amount of the upper cloth (front side) and the lower cloth (rear side) are both 60 g/m2. FIGS. 3 to 8 show minimum component units of weave structures of the hollow-weave airbag according to the practical examples and comparison examples. FIG. 3 shows the minimum component unit of practical example 1 of the hollow-weave airbag, FIG. 4 shows practical example 2, FIG. 5 shows practical example 3, FIG. 6 shows practical example 4, FIG. 7 shows comparison example 1, and FIG. 8 shows comparison example 2. The weave structure for all the practical examples and comparison examples of the hollow-weave airbag is the 1/1 bag structure.

Practical examples 1 and 2 are practical examples of the first embodiment of the hollow-weave airbag. In practical example 1, of the weave structures that constitute the closed portion 12, the first weave structure 12A that adjoins the bag portion 11 is formed by a 2/2 basket weave structure constituting of 4 weft yarns, and the second weave structure 12B that adjoins the side of the first weave structure 12A opposite the bag portion side is formed by a 1/1 plain structure constituting of 2 weft yarns. Furthermore, in practical example 2, of the weave structures that constitute the closed portion 12, the first weave structure 12A that adjoins the bag portion 11 is formed by a 2/2 basket weave structure constituting of 4 weft yarns, and the second weave structure 12B that adjoins the side of the first weave structure 12A opposite the bag portion side is formed by a 1/1 plain structure constituting of 4 weft yarns. Moreover, both practical examples 1 and 2 have a 3/3 structure third weave structure 12C on the side of the second weave structure 12B opposite the bag portion side.

In addition, practical examples 3 and 4 are practical examples of the second embodiment of the hollow-weave airbag. In practical example 3, of the weave structures that constitute the closed portion 12, the weave structure that adjoins the bag portion 11 is the reversed bag structure 121 that is constituted of warp yarns and 3 weft yarns, in practical example 4, of the weave structures that constitute the closed portion 12, the weave structure that adjoins the bag portion 11 is the reversed bag structure 121 that is constituted of warp yarns and 6 weft yarns. Note that in the closed portion 12, the third weave structure 12C that adjoins the side of the reversed bag structure 121 opposite the bag portion side has a single-layered structure (3/3 structure).

On the other hand, in comparison example 1, of the weave structures that constitute the closed portion 12, the weave structure that adjoins the bag portion 11 has a straight-line structure that is constituted of one closed portion weave structure, and the structure adjoining this is a single-layered structure (3/3 structure). Furthermore, in comparison example 2, of the weave structures that constitute the closed portion 12, the weave structure that adjoins the bag portion 11 is a 1/1 plain weave structure, and the structure adjoining the 1/1 plain weave structure is a single-layered structure (3/3 structure).

(2) Evaluation of Performance

Figure 9:
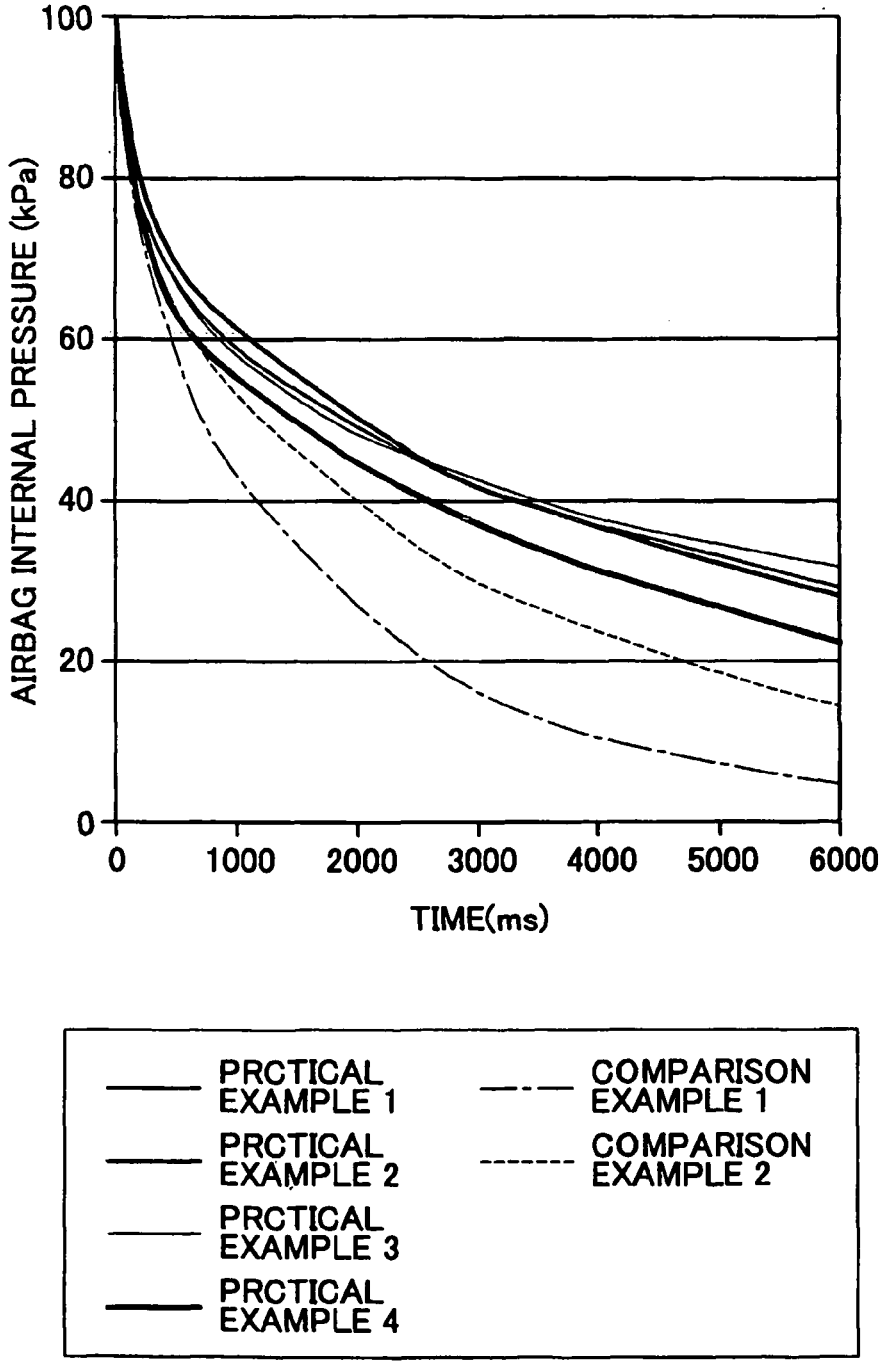
FIG. 9 is a graph of changes over time for the internal pressure of each hollow-weave airbag according to the embodiments and comparison examples.

The changes over time for the internal pressure of each hollow-weave airbag according to the practical examples and comparison examples was investigated using a method whereby an inflator was attached to each hollow-weave airbag according to the practical examples and comparison examples to cause deployment. Table 1 below shows the results. Furthermore, FIG. 9 shows a graph of changes over time for the internal pressure of each hollow-weave airbag according to the practical examples and comparison examples. Note that the measurement results in Table 1 are, regarding each hollow-weave airbag according to the practical examples and comparison examples, mean values measured with a sample number of N=2. Airtightness was evaluated based on these results.

TABLE 1

| | Airbag internal pressure (kPa) | | | | | |
|---|---|---|---|---|---|---|
| Time (ms) | Practical example 1 | Practical example 2 | Practical example 3 | Practical example 4 | Comparison example 1 | Comparison example 2 |
| 0 | 98 | 99 | 98 | 97 | 96 | 100 |
| 60 | 92 | 93 | 91 | 88 | 92 | 93 |
| 80 | 90 | 92 | 90 | 86 | 89 | 89 |
| 100 | 87 | 90 | 86 | 83 | 85 | 86 |
| 300 | 74 | 76 | 74 | 70 | 68 | 71 |
| 1000 | 59 | 61 | 58 | 55 | 43 | 53 |
| 3000 | 42 | 42 | 42 | 37 | 16 | 30 |
| 6000 | 29 | 28 | 31 | 22 | 4 | 14 |

(3) Effect of the Examples

Looking at Table 1 and FIG. 9, for each of the hollow-weave airbags according to comparison examples 1 and 2, the internal pressure of the airbags 6 seconds after deployment was 4 kPa and 14 kPa. Compared with this, for practical examples 1 and 2, which are hollow-weave airbags according to the first embodiment, the internal pressure of the airbags 6 seconds after deployment was 29 kPa and 28 kPa, and for practical examples 3 and 4, which are hollow-weave airbags according to the second embodiment, the internal pressure of the airbags 6 seconds after deployment was 31 kPa and 22 kPa. Based on the results, it was understood that all of the practical examples 1 to 4 possessed a more excellent airtightness than the hollow-weave airbags of the comparison examples. More specifically, it was understood that the hollow-weave airbags of practical examples 1 and 2 and the hollow-weave airbag of the practical example 3 that was formed with a reversed bag structure using 3 weft yarns possess a more excellent airtightness because the internal pressure of each of the hollow-weave airbags 6 seconds after deployment was large.

Note that the invention is not limited to the aforementioned specific practical examples, and various modifications are possible depending on purpose and application.

The invention claimed is:

1. A hollow-weave airbag comprising:

a bag portion; and a closed portion that has two or more weave structures and adjoins the bag portion; and wherein the closed portion includes, in sequence from a bag portion side, a first weave structure and a second weave structure, which adjoins a side of the first weave structure opposite the bag portion side, and the first weave structure includes one or more portions with a looser weave structure than the second weave structure;

wherein the closed portion is formed of a single layered weave;

wherein an interface density of the second weave structure is 4/3 or more; and wherein at least one portion of an outer surface of the bag portion and the closed portion, which includes at least a boundary of the bag portion and of the closed portion, is coated.

2. The hollow-weave airbag according to claim 1, wherein the first weave structure adjoins the bag portion.

3. The hollow-weave airbag according to claim 1, wherein the first weave structure is a 2/2 structure.

4. The hollow-weave airbag according to claim 3, wherein the 2/2 structure is constituted of 3 to 5 warp yarns and 3 to 5 weft yams.

5. The hollow-weave airbag according to claim 1, wherein the second weave structure has a 1/1 structure.

6. The hollow-weave airbag according to claim 5, wherein the 1/1 structure is constituted of 2 to 5 warp yarns and 2 to 5 weft yams.

7. The hollow-weave airbag according to claim 1, wherein an interlace density of the bag portion, the first weave structure and the second weave structure satisfies at least one of the conditions shown in (1) to (3) below, excluding, however, a case where the interlace density of the first weave structure and the interlace density of the second weave structure are both 4/3, (1) the interlace density of the bag portion is 1/2 or less, (2) the interlace density of the first weave structure is from 2/3 or more to 4/3 or less, and (3) the interlace density of the second weave structure is 4/3 or more.

8. The hollow-weave airbag according to claim 1, wherein a third weave structure adjoins a side of the second weave structure opposite the bag portion side.

9. The hollow-weave airbag according to claim 8, wherein the third weave structure has a looser weave structure than the second weave structure.

10. The hollow-weave airbag according to claim 8, wherein the value of the interlace density of the first weave structure is a value between the value for the interlace density of the second weave structure and the value for an interlace density of the third weave structure.

11. The hollow-weave airbag according to claim 8, wherein the third weave structure has an n/m structure (where n and m are both integers of 1 or more, excluding, however, a 1/1 structure).

12. The hollow-weave airbag according to claim 8, wherein the interlace density of the third weave structure is 1 or less.

13. A hollow-weave airbag that includes a bag portion and a closed portion that has 2 or more weave structures and adjoins the bag portion, wherein:

at least one of the weave structures that constitute the closed portion, and that adjoins the bag portion, has a reversed bag structure; the reversed bag structure having a lower cloth and an upper cloth, where the lower cloth of the reversed bag structure is formed of warp yarns and weft yarns that constitute an upper cloth of the bag portion, and the upper cloth of the reversed bag structure is formed of warp yarns and weft yarns that constitutes a lower cloth of the bag portion.

14. The hollow-weave airbag according to claim 13, wherein the reversed bag structure is formed of warp yarns and 3 to 7 and weft yarns that constitute the weave structure of the bag portion.

15. The hollow-weave airbag according to claim 1, wherein at least one portion of an outer surface of the bag portion and/or the closed portion is coated.

16. The hollow-weave airbag according to claim 1, wherein the weave structure that constitutes the boundary of the bag portion and the closed portion has a curved line structure.

17. The hollow-weave airbag according to claim 13, wherein at least one portion of an outer surface of the bag portion and/or the closed portion is coated.

18. The hollow-weave airbag according to claim 13, wherein the weave structure that constitutes the boundary of the bag portion and the closed portion has a curved line structure.

* * * * *

UNITED STATES PATENT AND TRADEMARK OFFICE

CERTIFICATE OF CORRECTION

PATENT NO. : 7,424,899 B2
APPLICATION NO. : 10/507523
DATED : September 16, 2008
INVENTOR(S) : Kazuhiko Mouri et al.

It is certified that error appears in the above-identified patent and that said Letters Patent is hereby corrected as shown below:

TITLE PAGE:

Please correct section (86) as follows

§371 (c)(1),
(2), (4) Date: Change "Feb. 22, 2005" to --Dec. 15, 2004--

Signed and Sealed this

Twenty-fifth Day of November, 2008

JON W. DUDAS
*Director of the United States Patent and Trademark Office*